US005370273A

United States Patent [19]

Rohloff et al.

[11] Patent Number: 5,370,273

[45] Date of Patent: Dec. 6, 1994

[54] MULTI-COMPONENT APPLICATOR ASSEMBLY

[75] Inventors: Robert R. Rohloff, Afton; Walter C. Pearson, St. Paul, both of Minn.

[73] Assignee: Minnesota Mining and Manufacturing Company, St. Paul, Minn.

[21] Appl. No.: 777,072

[22] Filed: Oct. 16, 1991

[51] Int. Cl.[5] ..... B67D 5/00

[52] U.S. Cl. ..... 222/132; 222/137; 222/145; 222/326; 222/386

[58] Field of Search ..... 222/132, 137, 135, 136, 222/145, 325, 326, 327, 386; 366/129, 130, 177; 604/82, 181, 183, 191

[56] References Cited

U.S. PATENT DOCUMENTS

| | | | |
|---|---|---|---|
| 2,826,339 | 3/1958 | Maillard | 222/137 |
| 3,286,992 | 11/1966 | Armeniades et al. | 259/4 |
| 3,302,832 | 2/1967 | Hardman et al. | 222/94 |
| 3,664,638 | 5/1972 | Grout et al. | 259/4 |
| 3,828,980 | 8/1974 | Creighton et al. | 222/137 |
| 3,952,920 | 4/1976 | Bergmann | 222/137 |
| 4,226,235 | 10/1980 | Sarnoff et al. | 128/218 |
| 4,228,924 | 10/1980 | Gilbert | 222/137 X |
| 4,260,077 | 4/1981 | Schroeder | 222/137 |
| 4,329,988 | 5/1982 | Sarnoff et al. | 128/218 |
| 4,471,888 | 9/1984 | Herb et al. | 222/137 |
| 4,538,920 | 9/1985 | Drake | 366/177 |
| 4,767,026 | 8/1988 | Keller et al. | 222/137 |
| 4,913,553 | 4/1990 | Falco | 366/129 |
| 4,915,695 | 4/1990 | Koobs | 222/137 X |
| 4,981,241 | 1/1991 | Keller | 222/145 X |
| 4,995,540 | 2/1991 | Colin et al. | 222/132 |
| 5,038,963 | 8/1991 | Pettengill et al. | 222/145 |

FOREIGN PATENT DOCUMENTS

| | | |
|---|---|---|
| 2335601 | 1/1975 | Germany . |
| 2064664A | 6/1981 | United Kingdom . |

OTHER PUBLICATIONS

Ratio-Pak Cartridge System, TSI-0117, Jul. 1989.

3M Bulletin "Introducing Scotch-Weld EPX Pneumatic Applicator System", 78-6900-2343-3.

3M Bulletin "Scotch-Weld EPX Applicator System", 78-6900-1401-0.

*Primary Examiner*—Andres Kashnikow

*Assistant Examiner*—Anthoula Pomrening

*Attorney, Agent, or Firm*—Gary L. Griswold; Walter N. Kirn; Mark W. Binder

[57] ABSTRACT

An applicator assembly is provided for concurrently dispensing plural flowable component materials in a mixed state. Moreover, the applicator assembly is more versatile and is particularly useful when one or more additional components are to be concurrently dispensed with the basic two component materials. The applicator assembly permits dispensing of additives with basic two part mixtures, and allows the application of three or more part chemical systems. A multi-component applicator assembly is described which is convertible between different component number multi-component arrangements, and includes a barrel assembly having at least one barrel detachably connected to the other barrels, at least two of which are fixed to one another.

39 Claims, 4 Drawing Sheets

MULTI-COMPONENT APPLICATOR ASSEMBLY

TECHNICAL FIELD

The present invention relates to a multiple component applicator assembly which dispenses plural component materials together in a mixed state from separate component material sources. More particularly, the present invention relates to such a multiple component applicator assembly which is convertible between plural component number assemblies.

BACKGROUND OF THE INVENTION

In typical multiple component applicator devices, component materials are stored separate from one another and are dispensed concurrently with one another such that the correct ratio of component materials for a proper mixture are provided. The component materials may be mixed within such applicator devices, or may be mixed externally after the proper proportional amounts are dispensed.

Generally, many types of adhesives, sealants, coatings and potting compounds may comprise multiple components. Such adhesives may include components including epoxies, urethanes, acrylics, polysulfides, polyesters, silicones, and any other known or discovered adhesive or sealant materials.

Epoxy adhesives are representative of such multiple component adhesives, and more generally of multiple component products, which require that the component materials be stored individually and which must be mixed in accordance with a specific ratio for usage. Epoxy adhesives typically include an epoxy resin component and a curing agent component such that when mixed together in proper proportion, the epoxy curative hardens in place. With this in mind, epoxy adhesive dispensing devices have been developed which include separate storage locations for the resin component and the curing agent component and a means for dispensing the separate components together and in accordance with the proper ratio for curing.

One manner of concurrently dispensing separate component materials is to provide the component materials within distinct cavities or barrels of an applicator device and to force the component materials from such cavities or barrels by actuation of a single element. Examples of dispensers including plural barrels which each contain a component material which is expelled by a plunger inserted within each barrel, and wherein the plungers are driven together by the manipulation of a single element are disclosed in U.S. Pat. Nos. 4,471,888 to Herb et al, 3,952,920 to Bergman, and 2,826,339 to Maillard, and in German Offenlegungsschrift 2,335,601. In each of these cases, the manipulation of either a trigger, a lead screw mechanism, or a plunger element directly results in the concurrent and equal movement of each plunger such that component material is expelled from plural cavities or barrels. One common disadvantage associated with each of the above devices is that such dispensers lack overall versatility, and they are not easily changed to accommodate different ratios for different component materials. In other words, the devices are substantially set at the manufacture thereof to dispense the component materials at preset ratios.

A somewhat more versatile dispenser is described in U.S. Pat. No. 3,828,980 to Creighton et al, in that the device includes a like number of pistons as there are component material holding barrels, wherein the pistons are separable from one another but are actuatable together by a separable rigid connecting means. However, the Creighton et al device is disadvantageous for the same reason as the above-described devices in that the multiple component barrels are formed as a single cartridge which is divided into compartments which are non-divisible from one another. Thus, the dispenser, whether having two or more component barrels, is limited in use to producing a mixture of that number of components as there are fixed barrels and at the predetermined ratio thereof.

Schroeder, U.S. Pat. No. 4,260,077, discloses yet a more versatile dispenser, wherein the dispenser comprises not only separable plungers, but also separable barrels. The barrels are detachably connected together by a sliding interlock, and the plungers are moved concurrently by inter-fitted elements. The principle advantage of the Schroeder device is that each one of the barrel and plunger assemblies is usable independently of the other. Moreover the dispenser is particularly directed to a dispenser which can equally dispense component material from two barrels and can be separated for individual use of each barrel and plunger assembly. Because of the need for each separable barrel and plunger assembly to be independently usable, each assembly necessarily includes all of the necessary operable component parts, including nozzles. Thus, even when connected together and dispensing two component materials together, the component materials are expelled through individual discharge openings, and the component materials must then be mixed together externally of the dispenser by other means.

A significantly advanced two component applicator assembly has been developed with increased two component versatility and is available as the "Scotch-Weld TM EPX Applicator System" from Minnesota Mining and Manufacturing Company of St. Paul, Minn., the assignee of the present invention. The "Scotch-Weld TM EPX Applicator System" comprises an applicator and plunger assembly to which a removable fixed two component barrel assembly is detachably connected. The barrel assembly further includes a separable static mixing nozzle connecting to the discharge openings of both components. Many varieties of two component room temperature curing products are available prepackaged within the removable barrel assemblies from Minnesota Mining and Manufacturing Company under the product line "Scotch-Weld Duo-Pak" adhesive cartridges. Thus, a user of the applicator can purchase any one of the available adhesives and simply attach the barrel assembly to the applicator and plunger assembly for dispensing. The individual prepackaged barrel assemblies for specific adhesives are designed in accordance with a predetermined mix ratio for that specific adhesive. Thus, a single applicator and plunger assembly can dispense any one of the variety of available two component adhesives at the predetermined ratio depending on the specific adhesive and use thereof.

A further variation has been developed and is available as the "RATIO-PAK TM Cartridge System" from Plus-Pak Industries, Inc., of Niantic, Conn. This system includes a removable cartridge system, like the "Scotch-Weld" TM System, where the cartridge system consists of two separable cartridges (barrels). Different cartridge sizes are available so that they can be configured to dispense components at selected mix ratios, specifically within the range of 1:1 to 10:1.

The "Scotch-Weld TM EPX Applicator System" and all other two component applicator devices suffer from a common problem which occurs when a third component, or more, is attempted to be added to the two components which is not compatible or stable with the other two components. Moreover, even if a third component is compatible or stable with at least one of the other two components, such two component devices lack the versatility to be able to selectively add such a third component to the other two components only when desired. For example, one may wish to add a third component during only a portion of the application of a two component adhesive. Examples of components not compatible or stable would include materials which react with the base material or anything of higher density than the base material, such as flame retardants, glass beads, conductive metal, thermally conductive fillers, and the like, where such higher density materials would tend to settle within the tubes during storage before use. In the same manner, lower density additives would tend to float within the base material destroying a uniform mixture.

Applicator devices including the capability of dispensing three or more components are also known. The aforementioned U.S. Pat. No. 2,826,339 to Maillard discloses in one embodiment a three component dispenser having three coaxial compartments from which the components are concurrently dispensed. Such a device, however, is no more versatile than a fixed two component device in that it is limited in use to component materials of a like number as there are fixed compartments.

Another three component dispenser is described in U.S. Pat. No. 4,995,540 to Colin et al, wherein a typical two barrel dispenser is provided with two separated component materials within one barrel and with a single component material within the other barrel. Thus, the separated component materials of the one barrel are sequentially dispensed and mixed with the single component material of the other barrel. This device does not permit dispensing of three or more components concurrently.

Falco, U.S. Pat. No. 4,913,553, discloses a multi-component dispensing apparatus having more than two component barrels, but which is limited to the provision of a pair of dispensing barrels for each component material to be dispensed. In other words, the device, in accordance with that invention, must have an even number of component barrels which are equally distributed about the drive axis of the device for balancing the device during application. It is suggested that more than two component materials can be dispensed if the additional components are provided by a pair of additional component barrels balanced about the drive axis. This device, like those described above is limited in use for applying and dispensing component materials of a specific number for which the applicator apparatus is specifically designed.

SUMMARY OF THE INVENTION

The present invention is directed to an applicator assembly for concurrently dispensing plural flowable component materials, which overcomes the aforementioned shortcomings associated with prior art multiple component dispensers. Specifically, the present invention has an increased versatility and is usable in situations where one or more additional components can be concurrently dispensed with basic two component materials. Furthermore, the present invention is particularly applicable to the dispensing of one or more additional components or additives concurrently with two part adhesives, sealants, coatings, and potting compounds, such as epoxies, urethanes, acrylics, polysulfides, polyesters, silicones, and the like. It is understood that any other such components are contemplated.

The present invention is beneficial in that it allows a user to apply three or more part chemical systems; for example, a third catalyst component or additive that may not be compatible and/or stable (reactable) with the other two components. Such an applicator assembly can advantageously utilize such a catalyst or an inhibitor to custom tailor the cure speed of adhesives, such as epoxies. More generally, the applicator assembly of the present invention permits the utilization of three or more part chemistries. In addition, the applicator assembly of the present invention accommodates the application of one or more additives with a conventional two part component material. For example, a color component material can be mixed with and dispensed with a conventional two part white or colorless adhesive to provide the ultimate color of the applied adhesive. Thus, a user could simply stock such a white or colorless adhesive and a variety of color components which could be selectively added for each particular situation. In the same sense, one or more of the following additives could be mixed and dispensed with a conventional two part adhesive: flame retardants, conductive fillers, other fillers, or the like. Such additives may be unstable and/or non-compatible with the components of the two part material such that mixture within one or both of the component materials would not be possible. The present invention allows such additives to be consistently and evenly mixed with the two component materials at the time of dispensing at application thereof to a substrate. Thus, the adverse affects are avoided. Non-stable additives include those that would physically settle out of the component materials during storage before use, as may occur when the additive has a higher or lower density than the component materials.

The aforementioned advantages are achieved in accordance with the present invention by a multi-component applicator assembly which is convertible between plural different component number multi-component arrangements, wherein the plurality of flowable component materials are concurrently dispensed in each arrangement. Moreover, the applicator assembly comprises a barrel assembly having three barrels, or more, each barrel containing a flowable component material and having a discharge port through which such flowable component materials are concurrently dispensed. One of the barrels is detachably connected with the other barrels of the barrel assembly. The applicator assembly further comprises means for concurrently dispensing the plural flowable component materials from the discharge ports of the barrels for each arrangement, and nozzle means for receiving the component materials from the discharge ports, for mixing the component materials and for dispensing the component materials from a single discharge outlet of the nozzle means. In accordance with this assembly, a first arrangement can be obtained with the detachable barrel connected with the barrel assembly wherein the nozzle means comprises a first nozzle element and a first nozzle adaptor positioned between the discharge ports of the barrels and the first nozzle element. The assembly is also capable of assuming a second arrangement without the detachable barrel connected to the barrel assembly, wherein the nozzle means comprises the first nozzle element, and does not include the first nozzle adaptor. More particularly, the means for concurrently dispensing the flowable component materials preferably comprises a plunger assembly including a plunger for each of the barrels and an advancing means for driving each plunger within the barrels, wherein the plungers are operatively connected with one another. Preferably, in one embodiment, the plunger assembly also includes a removable plunger which is associated with the detachable barrel. In another embodiment, the plunger associated with the detachable barrel comprises the drive rod of a conventional two component applicator device.

In another aspect of the present invention, the applicator assembly for concurrently dispensing a plurality of flowable component materials comprises a plurality of barrels which are fixed with one another and having discharge ports through which flowable component material is to be concurrently dispensed; a removable barrel assembly releasably attached to the fixed plurality of barrels, including at least one removable barrel for containing a flowable component material; and a means for concurrently dispensing the flowable component materials from the discharge ports of at least two of the fixed plurality of barrels and the at least one removable barrel.

In yet another aspect of the present invention, a supplemental component assembly is provided for converting an existing multi-component applicator device, which is used for concurrently dispensing a plurality of flowable component materials, into an increased component number multi-component applicator assembly. The supplemental component assembly comprises a detachable barrel assembly including at least one removable barrel with a discharge port and means for detachably connecting the removable barrel to a barrel assembly of the multi-component applicator. Furthermore, a nozzle adaptor means is provided for connecting with the discharge port of the removable barrel and which is further connectable with the discharge ports of the component barrels of the multi-component applicator device. The nozzle adaptor means includes passages defining flow paths from the discharge ports of the barrels to a common passage within which all of the component materials are mixed with one another and which leads to a single adaptor outlet from which the mixed material is dispensed.

BRIEF DESCRIPTION OF THE DRAWINGS

The present invention will be further described below with reference to the accompanying drawings, wherein the plural embodiments in accordance with the present invention are illustrated and described, in which.

DETAILED DESCRIPTION OF THE PREFERRED EMBODIMENTS

Figure 1:
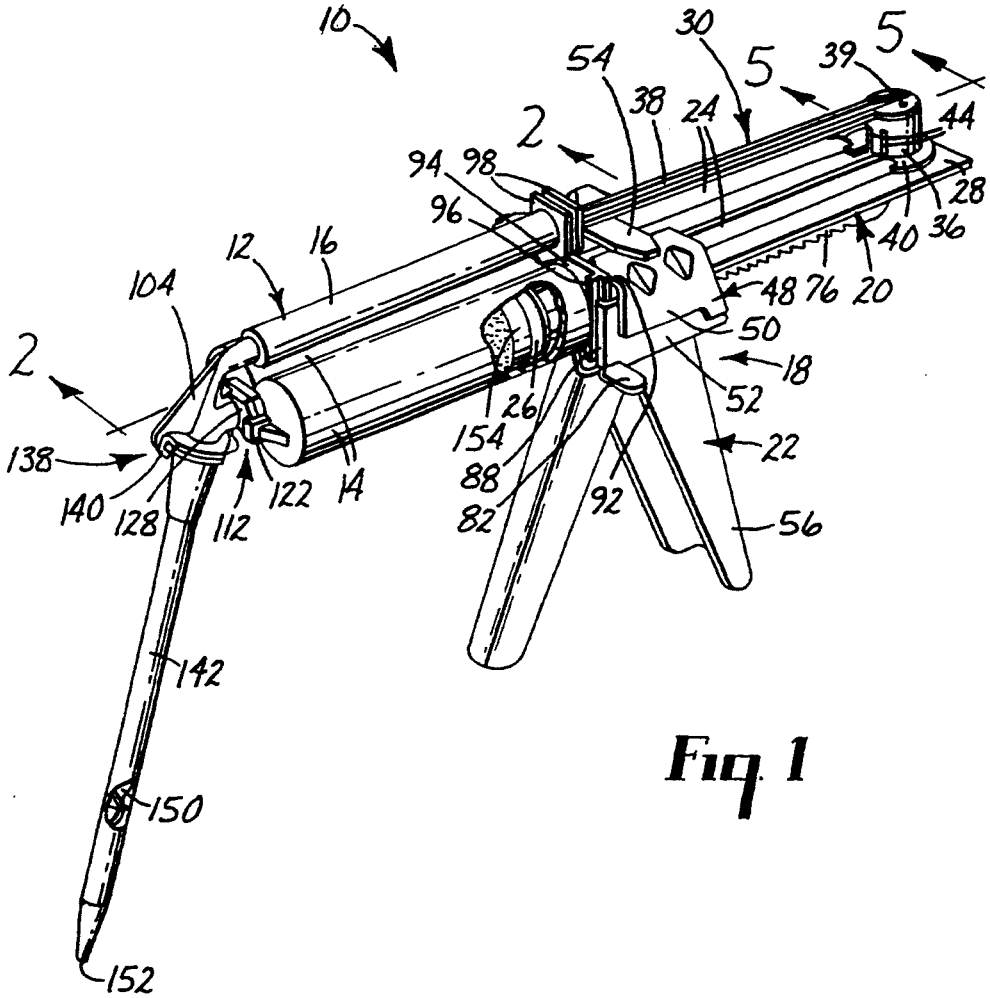
FIG. 1 is a perspective view of a multi-component applicator assembly formed in accordance with the present invention.
Figure 2:
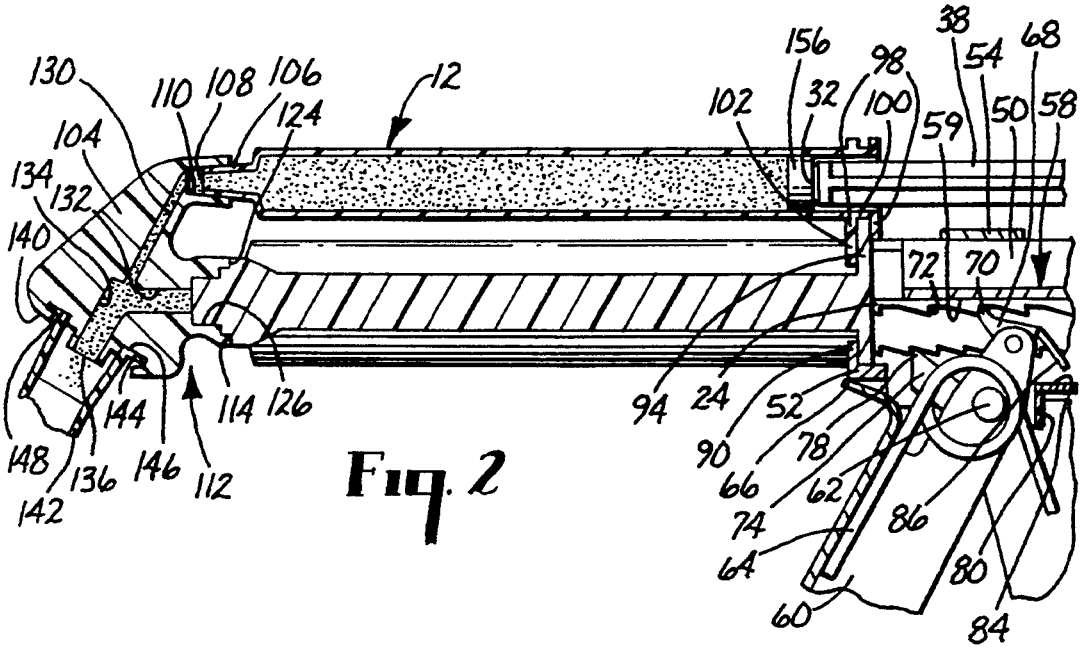
FIG. 2 is a cross-sectional view taken along line 2—2 in FIG. 1.

With reference now to the figures, wherein like numerals are used to designate like components throughout each of the several figures, and initially to FIGS. 1 and 2, a multi-component applicator assembly 10 is illustrated. The multi-component applicator assembly 10 includes a barrel assembly 12 having a plurality of barrels 14 fixed with respect to one another and at least one detachable barrel 16. The barrel assembly 12 is also preferably easily separable from the remainder of the applicator assembly 10, the remainder comprising a means for concurrently dispensing flowable component materials 18.

The means for concurrently dispensing flowable component materials 18 comprises a plunger assembly 20 and an advancing means 22. The plunger assembly 20 comprises a fixed plunger 24 for each fixed barrel 14. In the embodiment illustrated in FIG. 1, there are two fixed barrels 14 within which a like number of fixed plungers 24 are slidably disposed. The fixed plungers 24 are substantially independent from one another along their longitudinal length from the ends 26 thereof which are inserted within the fixed barrels 14 so as not to obstruct longitudinal movement of such ends 26 along the longitudinal length of and within the fixed barrels 14. However, in order to fixedly connect the fixed plungers 24 together so as to be assured of moving together, a web portion 28 is provided at the ends of fixed plungers 24 distal from the inserted ends 26. Thus, the fixed plungers 24 are operatively connected to move with one another at all times.

The plunger assembly 20 further includes an auxiliary plunger 30 which is operatively attached with the fixed plungers 24, preferably at the web portion 28 thereof. The auxiliary plunger 30 is given a length that operatively corresponds to the length of each fixed plunger 24 such that an end 32 thereof is inserted within detachable barrel 16 to substantially the same degree that the ends 26 of fixed plungers 24 are inserted within fixed barrels 14. That is, the end surfaces of end 32 and ends 26 of the auxiliary plunger 30 and fixed plungers 24, respectively, lie substantially within the same transverse plane. Thus, the advancing means 22, described below, concurrently moves fixed plungers 24 and auxiliary plunger 30 together such that the ends 32 and 26 thereof move together. That is, at the same time and over the same displacement.

Figure 5A:
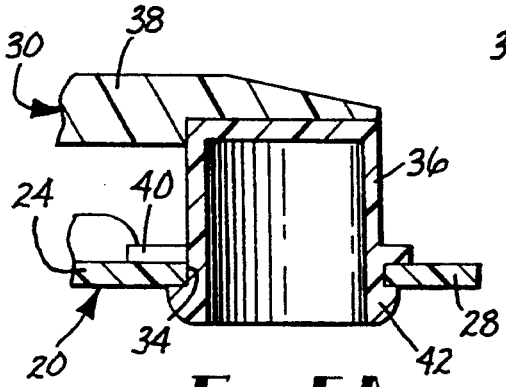
FIG. 5A is a cross-sectional view taken along line 5—5 in FIG. 1 illustrating a detachable connection between plungers of the plunger assembly in accordance with the present invention.
Figure 5B:
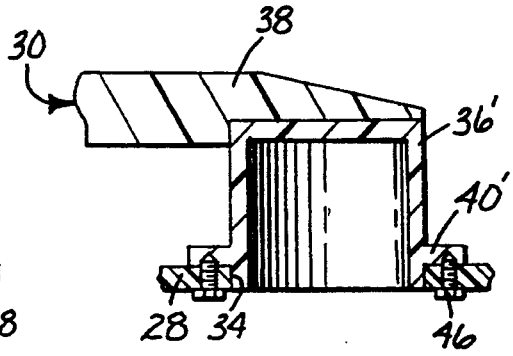
FIG. 5B is a cross-sectional view taken along line 5—5 in FIG. 1 illustrating another detachable connection between plungers in accordance with the present invention.

Auxiliary plunger 30 is operatively connected with the web portion 28 by any conventional technique. Preferably, the auxiliary plunger 30 is detachably connected to the web portion 28. As shown in FIGS. 5A and 5B, alternate techniques are illustrated to provide such a detachable connection, although other techniques are contemplated. In the case illustrated in FIG. 5A, the web portion 28 is provided with an opening 34 within which a hub portion 36 of the auxiliary plunger 30 is inserted. The opening 34 in the preferred embodiment is circular; however, other shaped openings are contemplated and can be advantageously used. The auxiliary plunger 30 further includes a stem portion 38 which is connected with the hub portion 36 by any conventional means, such as screws 39 as shown in FIG. 1. The stem portion 38 could alternatively be snap fitted or plugged into the side of hub portion 36. The hub portion 36 is similarly shaped at its lower portion to the shape of the opening 34 and includes a perimetric flange 40 which sets on an upper surface of the web portion 28. In order to lock hub portion 36 to the web portion 28, and thus operatively fixedly attach the auxiliary plunger 30 to the fixed plungers 24, tabs 42 are resiliently connected with the hub portion 36 so that they can be sprung inwardly to pass through the opening 34 but are biased to a locked position as shown in FIG. 5A. The tabs 42 are conventionally provided such as by slots 44 shown in FIG. 1.

In the case illustrated in FIG. 5B, the hub portion 36' is similarly provided with a perimetric flange 40' which sets on the upper surface of the web portion 28. The lower end of the hub portion 36' extends within the opening 34. The perimetric flange 40' is detachably connected with web portion 28 by screws 46 which pass through bores provided within the web portion 28 and are threaded into the perimetric flange 40'. It is understood that many other types of detachable connections could be substituted for those illustrated in FIGS. 5A and 5B, where the purpose is such that the auxiliary plunger 30 can be detachably connected with fixed plungers 24 but which when connected are operatively fixed such that all of the plungers move concurrently and equally.

The fixed plungers 24 of plunger assembly 20 are slidably disposed within and supported by a housing 48 of the advancing means 22. The manner of constructing the housing 48 is not critical to the present invention and may be done in any manner so long as the plunger assembly 20 is slidably guided therethrough. As shown, housing 48 comprises, in fixed relation to one another, a top element 50, a bottom element 52, a reinforcing element 54, and a handle element 56. As seen in FIG. 2, the top element 50 includes an inset portion 58 having a lower guide surface 59 which rides against an upper surface of fixed plungers 24. Additional guide surfaces (not shown) are also preferably provided extending inwardly from the upper edges of both sides of the bottom element 52 so as to ride against lower surfaces of the fixed plungers 24. Each of the aforementioned housing elements are fixedly connected with one another by conventional means, which in the case of metal components may be by spot welding or mechanically fastening with rivets, bolts, clips, or the like, or with plastic components by adhesives, heat sealing, mechanical fastening, or the like.

A trigger 60 is pivotally mounted to the handle element 56 at pivot pin 62. The trigger 60 is biased to a forwardmost position by a torsion spring 64 which urges a stop element 66 against the bottom element 52. Pivotably mounted atop the trigger 60 is a drive pawl 68 which is spring biased (not shown) in a clockwise direction as shown in FIG. 2 by a conventional torsion spring. Thus, when the lower portion of trigger 60, below pivot pin 62, is grasped by a user and urged toward handle element 56, the drive pawl 68 is driven forwardly; that is, toward barrel assembly 12. The drive pawl 68 includes a tooth 70 which engages with ratchet teeth 72 extending downwardly from a relatively horizontal lower surface of one or both (preferably both) of the fixed plungers 24. Moreover, the bias of the drive pawl 68 urges tooth 70 thereof into engagement with the ratchet teeth 72, such that during forward movement of the drive pawl 68 by manipulation of trigger 60, the drive pawl 68 urges the fixed plungers 24 and thus auxiliary plunger 30 forwardly. In accordance with known ratchet and pawl mechanisms, during the movement of trigger 60 back to its forwardmost position under the influence of torsion spring 64, the drive pawl 68 rides over the ratchet teeth 72 without moving the fixed plungers 24. To further ensure that such reverse movement of the fixed plungers 24 does not take place, an anti-reverse pawl 74 is preferably pivotally mounted about the pivot pin 62, and is likewise spring biased (not shown) in a clockwise manner by a conventional spring arrangement which effectively urges the anti-reverse pawl 74 so as to engage with a second set of ratchet teeth 76 of fixed plungers 24. It is not necessary that the ratchet teeth 76 be provided, since frictional engagement of the anti-reverse pawl 74 with the fixed plungers 24 would suffice. It is also understood that many other techniques could be used for the described purpose. The anti-reverse pawl 74 does not move longitudinally during manipulation of the trigger 60, and the tip 78 thereof remains in engagement with one of the second set of ratchet teeth 76 after forward movement of the fixed plungers 24 to prevent reverse movement. During the forward movement, the tip 78 rides over ratchet teeth 76. Preferably, ratchet teeth 76 are provided at the bottom edge of both fixed plungers 24, and an anti-reverse pawl 74 is provided at both sides of handle element 56. Moreover, both anti-reverse pawls 74 are preferably connected together by a transverse link 80 so that they act in concert with one another.

In order to release the anti-reverse pawls 74 and the drive pawl 68 so that the plunger assembly 20 can be returned to its fully extended position, that is with ends 26 and 32 thereof withdrawn from barrels 14 and 16, respectively, a release lever 82 is provided which is a traverse extension of one of the anti-reverse pawls 74. Thus, when the release lever 82 is pushed downwardly against the spring bias of both anti-reverse pawls 74, both anti-reverse pawls 74 are moved out of engagement with the ratchet teeth 76 of fixed plungers 24. Furthermore, fixed atop the transverse link 80 connecting the anti-reverse pawls 74, is an abutment surface 84 which contacts an arm 86 of the drive pawl 68 so as to urge drive pawl 68 away from ratchet teeth 72 at the same time that anti-reverse pawls 74 are released from the second set of ratchet teeth 76 upon depression of the release lever 82. Thus, as can be seen, the plunger assembly 20 is free to move relative to housing 48.

As mentioned above, the barrel assembly 12 is easily removable from the housing 48 so that any number of barrel assemblies having a similar mount can be interchanged and connected to the means for concurrently dispensing flowable component materials 18. Specifically, housing 48, at bottom element 52, includes side flanges 88, a bottom flange 90, and upper edges 92 of top element 50, which together define a receiving space for a mounting portion 94 of the barrel assembly 12. The mounting portion 94 is preferably integrally made with the fixed barrels 14, and preferably, the fixed barrels 14 and mounting portion 94 are molded as a single unit. The mounting portion 94 further preferably includes alignment ribs 96 to facilitate the proper alignment of the fixed barrels 14 to the housing 48. As a result of this easily releasable connection, a barrel assembly 12 can be easily connected to the housing 48 by simply dropping the mounting portion 94 from above within the receiving space defined by side flanges 88, bottom flange 90, and upper edges 92 of housing 48 when the plunger assembly 20 is sufficiently retracted so as not to interfere with such insertion. After the barrel assembly 12 is connected with the housing 48, advancement of the plunger assembly 20 prevents the barrel assembly 12 from being removable from housing 48 until the plunger assembly 20 is once again retracted using release lever 82 as described above.

The detachable barrel 16 is releasably connected with the fixed barrels 14 at the mounting portion 94 thereof by way of a pair of spaced alignment flanges 98 in between which a top edge 100 of the mounting portion 94 is snugly inserted. Although the alignment flanges 98 are illustrated surrounding the detachable barrel 16, it is only necessary that they extend from the bottom side of detachable barrel 16 in order to engage the mounting portion 94. Preferably, the forwardmost spaced alignment flange 98 is further provided with an angled tip 102 which fits between the fixed barrels 14 to transversely locate the detachable barrel 16 relative thereto in proper position. It is also contemplated that a conventional locking feature could be provided between one of or both of alignment flanges 98 and the mounting portion 94. For example, a detent (not shown) could be provided on one face of the mounting portion 94 which snap fits within a recess (not shown) provided on the face of one of the alignment flanges 98. As a result, the detachable barrel 16 is independently detachable from the fixed barrels 14 without regard to whether or not the barrel assembly 12 is attached to or separate from the housing 48 of the remainder of the applicator assembly 10.

Figure 9:
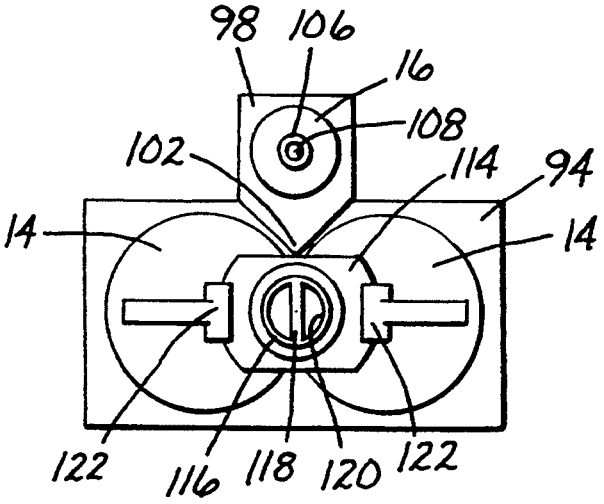
FIG. 9 is a front end view of the barrel assembly illustrated in FIG. 1 with the nozzle adaptor removed.

A nozzle adaptor 104 is provided at the discharge ends of fixed barrels 14 and detachable barrel 16. As seen in FIG. 2, detachable barrel 16 has a reduced diameter nozzle 106 and a discharge port 108. The nozzle 106 is preferably slightly tapered for insertion within a similarly tapered cavity 110 of nozzle adaptor 104. The taper fit is preferable in order to make a substantially fluid tight connection of the nozzle adaptor 104 to the barrel assembly 12. In order to physically connect the nozzle adaptor 104 to the barrel assembly 12, a releasable connecting means 112 is provided therebetween. The releasable connecting means 112 includes, as shown in FIG. 9, a substantially flat mounting surface 114 which surrounds a common nozzle 116 for both fixed barrels 14. The common nozzle 116 includes an internal wall 118 which bisects the opening of common nozzle 116 into two discharge ports 120, each discharge port 120 being associated with one of the interiors of fixed barrels 14. Thus, component materials can be dispensed from separate discharge ports 120 but through a single common nozzle 116. At diametrically opposed points about the common nozzle 116, lock elements 122 are provided with portions thereof spaced from and partially overlapping the flat mounting surface 114. The lock elements 122 are preferably integrally formed with the fixed barrels 14 and the flat mounting surface 114 such as by a molding process.

The nozzle adaptor 104 includes a corresponding substantially flat mounting surface 124 which abuts the flat mounting surface 114 of the barrel assembly 12. Additionally, a cavity 126 is provided for accommodating the common nozzle 116. On the external surface of the nozzle adaptor 104, opposite to the flat mounting surface thereof, a plurality of cam surfaces 128 are provided of a like number as there are lock elements 122 of barrel assembly 12. The cam surfaces 128 engage with the inner overlapping surfaces of the lock elements 122 so as to lock the nozzle adaptor 104 to the fixed barrels 14 and to hold flat mounting surfaces 114 and 124 to a substantially fluid tight seal. To connect the nozzle adaptor 104 with the fixed barrels 14, the mounting surface 124 is applied against the mounting surface 114, but with the nozzle adaptor 104 out of rotation by 90 degrees. Then, during rotation of the nozzle adaptor 104 to its normal position illustrated in FIG. 1, the cam surfaces 128 act against the lock elements 122 and the nozzle adaptor 104 is locked against the fixed barrels 14. A stop surface (not shown) is also preferably provided at the ends of cam surfaces 128 to limit the rotation of the nozzle adaptor 104. Next, the nozzle end 106 of the detachable barrel 16 is inserted within the cavity 110 of the nozzle adaptor 104 and the detachable barrel 16 is further connected to the mounting portion 94 at top edge 100 thereof between spaced alignment flanges 98.

Within the nozzle adaptor 104, a first passage 130 is provided extending from the cavity 110. A second passage 132 is provided from cavity 126, and both passages 130 and 132 intersect with one another at a common passage 134 which leads from that intersection to a single adaptor outlet 136. By this arrangement, component material discharged from the discharge port 108 of detachable barrel 16 passes through passage 130 while component materials expelled from both discharge ports 120 from fixed barrels 14 are discharged to together travel through passage 132. Mixture of component materials from the separate fixed barrels 14 begins to occur within the passage 132. Then, the partially mixed component materials from passage 132 are mixed with the component material from passage 130 at the intersection of passages 130 and 132, and this mixture further takes place within the common passage 134 leading to the single adaptor outlet 136.

The nozzle adaptor 104 is further provided with a releasable connecting means 138 surrounding the adaptor outlet 136 and including lock elements 140, preferably molded with the nozzle adaptor 104, which are similar to the lock elements 122 of the first releasable connecting means 112. Moreover, the releasable connecting means 138 connects the nozzle adaptor 104 with a nozzle extension 142. In the same manner as the above-described releasable connecting means 112, the releasable connecting means 138 further comprises a flat mounting surface on the nozzle adaptor 104 which surrounds the adaptor outlet 136 and a corresponding flat mounting surface 146 on the nozzle extension 142. Again, the nozzle extension 142 includes cam surfaces 148 which interact with the lock elements 140 during a 90 degree rotation of the nozzle extension 142 to lock the nozzle extension 142 with the nozzle adaptor 104. The nozzle extension 142 is released by rotating the nozzle extension 142 in a reverse direction of the locking direction by 90 degrees. It is important, but not essential, that connecting means 112 and 138 be similar so that the applicator assembly 10 is useable as a two component device or with additional components, as further emphasized below.

Within the nozzle extension 142, a static mixing element 150 is provided. The manner of implementing the static mixing element 150 within the nozzle extension 142 is shown and described in U.S. Pat. Nos. 3,286,992 and 3,664,638, the disclosures of which are fully incorporated herein by reference. Basically, the static mixing element 150 consists of a multiple number of serially arranged blades twisted with respect to one another. Moreover, the static mixing element 150 completely mixes the multiple component materials as they move through the nozzle extension 142. This system avoids the introduction of air during the mixing, which results in a better mixing of the component materials, and provides a dispensed line of mixed material which is dense and substantially void free. The mixed material is finally dispensed from an applicator assembly dispensing outlet 152 at the tip of the nozzle extension 142.

Figure 8A:
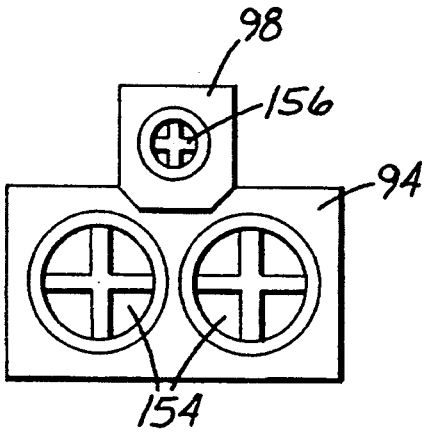
FIG. 8A is an end view of the barrel assembly shown in FIG. 1 which is detached from the remaining applicator assembly showing the relationship between the diameters of the barrels in accordance with one preferred mixing and dispensing ratio of component materials.
Figure 8B:
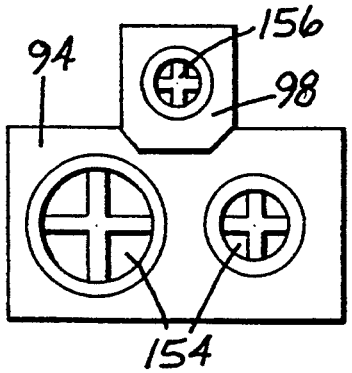
FIG. 8B is a view similar to FIG. 8A showing a different relationship of barrel diameters in accordance with another preferred mixing and dispensing ratio of component materials.

In an important aspect of the present invention, the multi-component applicator assembly 10 is a more versatile assembly than the currently available "Scotch-Weld TM EPX Applicator System" which dispenses two mixed components, and is available from Minnesota Mining and Manufacturing Company of St. Paul, Minn., the assignee of the present invention. As part of the "Scotch-Weld TM EPX Applicator System" two component barrel assemblies are available from Minnesota Mining and Manufacturing Company under the line of adhesive products known as "Duo-Pak" adhesives. A wide variety of adhesives are available, and the barrel diameters for specific components are designed depending on the component materials and the desired mixing ratio of the two component materials. This feature is illustrated in FIGS. 8A and 8B, where in FIG. 8A, the diameters of the fixed barrels 14 are substantially equal, corresponding to a 1:1 mixing ratio of component materials, and in FIG. 8B, the fixed barrels 14 have diameters corresponding to a 2:1 final mixing ratio of component materials from the fixed barrels 14. In the same sense, and also illustrated in FIGS. 8A and 8B, the detachable barrel 16 is designed with an appropriate diameter in accordance with the desired mixing ratio of the final mixture of the three, or more, component materials. As also shown in FIGS. 8A and 8B, the component materials are preferably provided within each of the fixed barrels 14 and detachable barrel 16, and each barrel includes its own slidable piston 154 and 156, respectively, which is driven by the fixed plungers 24 and auxiliary plunger 30, respectively. However, it is also contemplated that the plungers 24 and 30 could be provided in a sealed relationship with the internal walls of the barrels such that pistons 154 and 156 are unnecessary.

In another important aspect of the present invention, a supplemental component assembly is provided which is capable of converting the above-described two component "Scotch-Weld TM EPX Applicator System" to a three or more component applicator assembly. As a result, currently available two component "Scotch-Weld TM EPX Applicators" can be retrofitted to be useable for dispensing three or more components. Such a retrofit would include the auxiliary plunger 30, which is connectable to the web portion 28 of fixed plungers 24 as shown in FIGS. 5A and 5B; the detachable barrel 16, which is connectable to the mounting portion 94 of the fixed barrels 14; and a nozzle adaptor 104 which is insertable between the fixed barrels 14 and the nozzle extension 142 and which is further connected to the detachable barrel 16.

Figure 3:
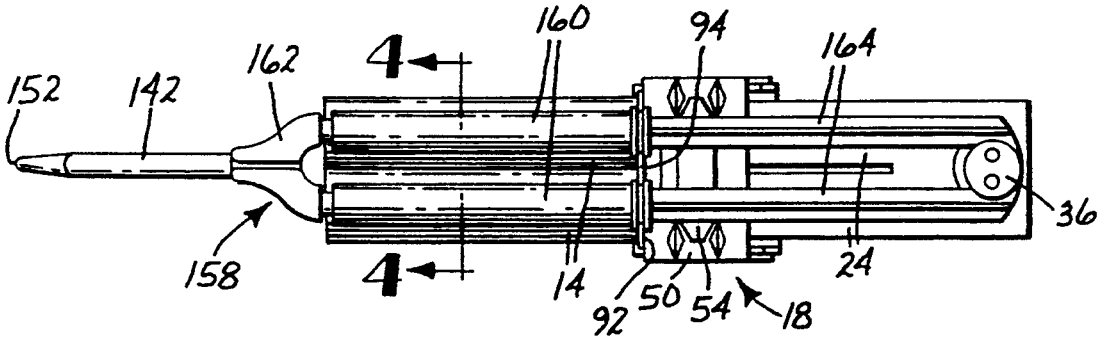
FIG. 3 is a top view of a modified multi-component applicator assembly having a plurality of detachable barrels.
Figure 4:
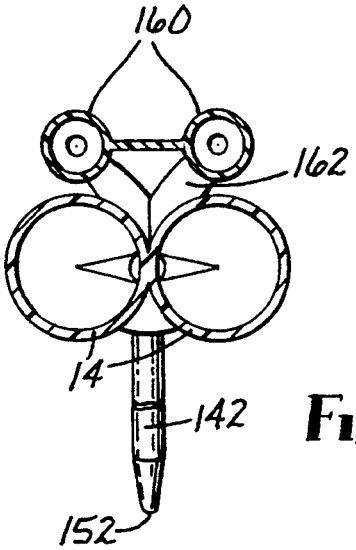
FIG. 4 is a transverse cross-sectional view taken along line 4—4 in FIG. 3.

As shown in FIGS. 3 and 4, a multiple component detachable barrel assembly 158 could be just as easily provided as the single detachable barrel 16. In this regard, two detachable barrels 160 are illustrated with the understanding that more detachable barrels could be provided if desired. Such a multiple component detachable barrel assembly 158 further necessitates a modified nozzle adaptor 162 with a corresponding number of passages as there are detachable barrels 160 that lead to a common discharge passage. The detachable barrels 160 may be separately provided, that is free of connection to one another by being independently mounted on the mounting portion 94 of the fixed barrels 14 in the same manner as the above-described detachable barrel 16. Alternately, the detachable barrels 160 could be provided as a single unit fixed with one another. Lastly, such an assembly further requires that the plunger assembly 20 include a like number of auxiliary plungers 164 as there are detachable barrels 160, with each auxiliary plunger fixed with a hub portion 36 and thus the web portion 28 of the fixed plungers 24 in the same manner as illustrated in FIGS. 5A and 5B.

Figure 6:
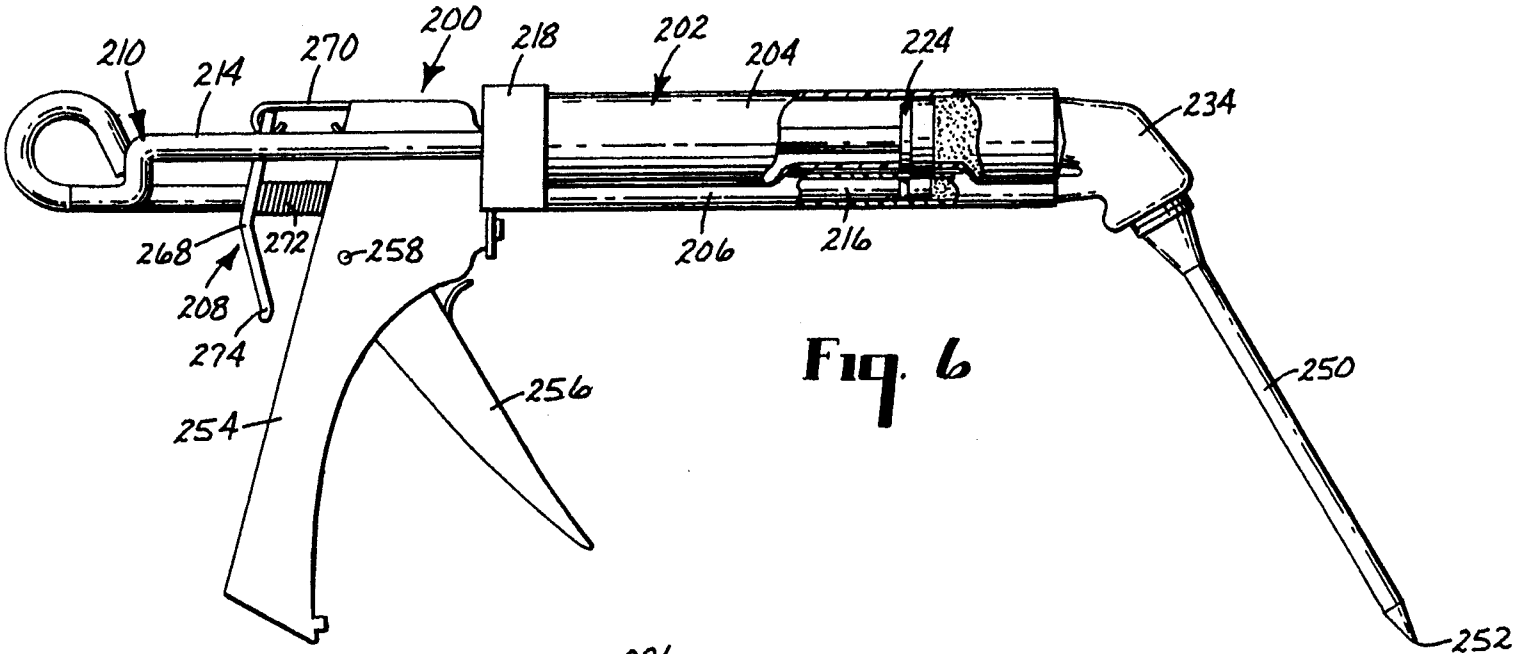
FIG. 6 is a side view, partially in cross section, of another embodiment of a multi-component applicator assembly formed in accordance with the present invention.
Figure 7:
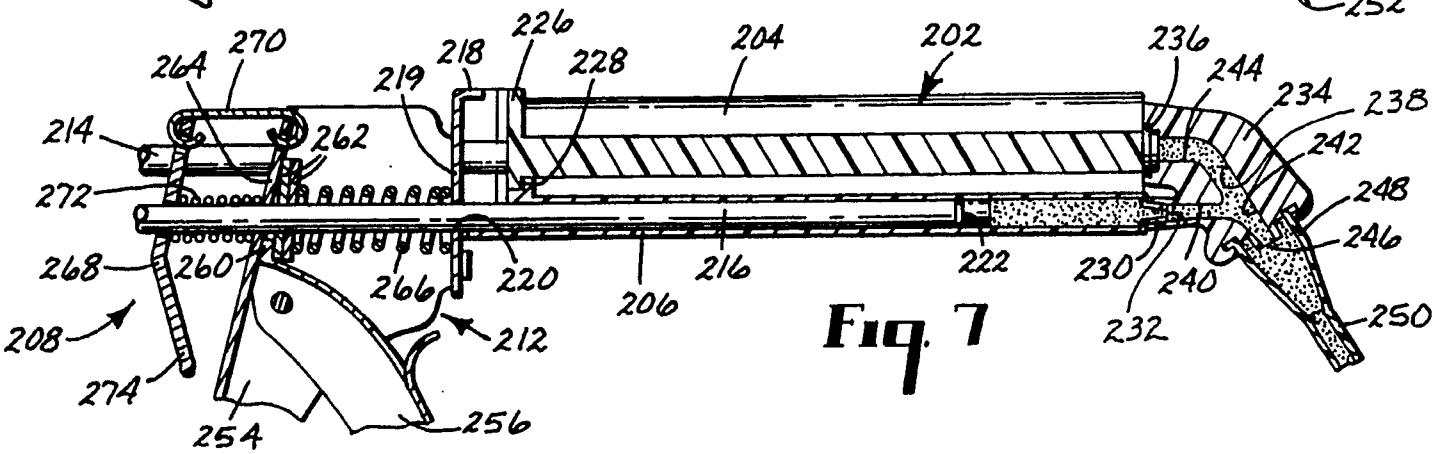
FIG. 7 is a longitudinal cross-sectional view through the multi-component applicator assembly illustrated in FIG. 6.

Referring now to FIGS. 6 and 7, another embodiment of a multi-component applicator assembly 200 is illustrated and described below in accordance with the present invention. Like the multi-component applicator assembly 10, applicator assembly 200 comprises a barrel assembly 202 including a plurality of fixed barrels 204 (only one of which is shown) and a detachable barrel 206, and a means for concurrently dispensing flowable component materials 208 which is made up of a plunger assembly 210 and an advancing means 212. The plunger assembly 210 comprises fixed plungers 214 of a like number as there are fixed barrels 204, wherein the fixed plungers 214 are fixed with a drive rod 216 such that as the drive rod 216 is driven forwardly or rearwardly, the fixed plungers 214 move concurrently therewith. In accordance with this embodiment of the present invention, the drive rod 216 is advantageously used as an auxiliary plunger for expelling component material from the detachable barrel 206. As seen in FIG. 7, the drive rod 216 is slidingly supported by a housing 218 at a rear wall 219 thereof. Rear wall 219 is provided with an opening 220 through which the drive rod 216 is slidably engaged.

After passing through the housing 218, the drive rod 216 extends within the detachable barrel 206, which is held in place against housing 218 as described below. An end 222 of drive rod 216 lies in substantially the same plane as the end surface of the plunger discs 224 of fixed plungers 214. Thus, component materials from the fixed barrels 204 and the detachable barrel 206 are discharged concurrently, over the same displacement, and in accordance with a pre-determined mixing ratio depending on the chosen diameters of the fixed barrels 204 and the detachable barrel 206.

The fixed barrels 204 include a mounting portion 226 which fits within a receiving space of the housing 218 defined by flanges (not shown) similar to those described above in the first embodiment at 88, 90, and 92. The fixed plungers 214 are also slidably guided through the rear wall 219 of housing 218 through openings thereof and into the fixed barrels 204. At the forward ends of fixed barrels 204, discharge ports (not shown) are provided in the same manner as that illustrated in FIG. 9 and described above. That is, each fixed barrel 204 is provided with a discharge opening, and each discharge opening is provided within a common nozzle separated by internal walls.

The detachable barrel 206 fits against housing 218 to axially fix the detachable barrel 206 in one direction. More specifically, detachable barrel 206 includes a tab 228 which rests against a front surface of the mounting portion 226 of the fixed barrels 204. At the forward end of the detachable barrel 206, a discharge nozzle 230 is provided including a discharge port 232.

At the forward end of both the fixed barrels 204 and the detachable barrel 206, a nozzle adaptor 234 is provided which is releasably connected with the fixed barrels 204 by a releasable connecting means 236 which is the same as the releasable connecting means 112 and 138 described above. It is understood that other connecting means can easily be substituted, such as threads or other quick connect systems, so long as the nozzle adaptor 234 is releasably attached to the fixed barrels 204 and can provide a fixed substantially fluid tight connection. Furthermore, nozzle adaptor 234 is provided with a cavity 238 within which the discharge nozzle 230 is tightly releasably inserted. A passage 240 provides a fluid communication path from the discharge port 232 of the detachable barrel 206 and leads to a common passage 242 which further leads from a passage 244 providing fluid communication from the discharge ports of the fixed barrels 204. As above, component materials dispensed from the fixed barrels 204 initially mix within the passage 244, and then that mixture is further mixed with the component material from the detachable barrel 206 within common passage 242 and finally discharged from the single adaptor outlet 246.

At the forward end of the nozzle adaptor 234, another releasable connecting means 248 is provided which is the same as the releasable connecting means 236 and thus preferably connecting means 112 and 138. Again, it is important, but not essential, that both connecting means 236 and 248 be similar to one another so that the applicator assembly 200 has applicability as a two component dispenser as well as a three or more component dispenser which requires the nozzle adaptor 234 inserted between the fixed barrels 204 and a nozzle extension 250. The nozzle extension 250 is preferably identical to the nozzle extension 142 described above including a static mixing element and an applicator assembly dispensing outlet 252.

As part of the advancing means 212, a handle element 254 is fixed with the housing 218. A trigger 256 is pivotally attached to the handle 254 at pin 258. The trigger 256 further includes an engagement portion 260 which is located at an opposite side of the pivot pin 258 from the portion of trigger 256 which is gripped by a user so as to be driven forwardly as the trigger is pulled toward the handle element 254. The engagement portion 260 engages with drive washers 262 which are slidably disposed on the drive rod 216 by openings at least slightly larger than the diameter of the drive rod 216 and which are held in a canted position by a wall portion 264 of the handle element 254 and the engagement portion 260. The drive washers 262 are held in that position by a compression spring 266 which acts against the rear wall 219 of housing 218 and a front surface of the forwardmost drive washer 262. The compression spring 266 also acts to bias the trigger 256 to its position farthest away from the handle element 254. When the trigger 256 is squeezed against the handle element 254, the engagement portion 260 drives the drive washers 262 forwardly as the drive washers 262 lock themselves to the drive rod 216 due to the canting relationship thereof so as to force the drive rod 216 forwardly, which in turn drives fixed plungers 214 therewith.

In order to prevent the drive rod 216 from moving rearwardly after trigger 256 is released and is forced forwardly by the compression spring 266, an anti-reverse element 268 is provided through which the drive rod 216 is also slidably disposed. The opening through which the drive rod 216 passes is also slightly larger than the diameter of the drive rod 216 so that the anti-reverse element 268 is normally canted with respect to the longitudinal axis thereof. The anti-reverse element 268 is positioned by a link 270 and is biased to the canted position by a second compression spring 272. Thus, after the trigger 256 is squeezed against the handle element 254 and the drive rod 216 is driven forwardly, the anti-reverse element 268 frictionally grips the drive rod 216 under the control of the bias provided by second compression spring 272 to hold drive rod 216 from rearward movement. In order to return the drive rod 216 to its rearward position, and to remove the fixed plungers 214 and the drive rod 216 from within the fixed barrels 204 and the detachable barrel 206, a lower end 274 of the anti-reverse element 268 is depressed which substantially aligns the opening therethrough with the longitudinal axis of the drive rod 216 such that drive rod 216 can be easily slid rearwardly by gripping the plunger assembly 210 and pulling rearwardly.

In the same manner as the embodiments described above, the multi-component applicator assembly 200 is advantageously convertible between plural multi-component arrangements of different component numbers. Moreover, a conversion assembly is also provided which comprises the detachable barrel 206 and the nozzle adaptor 234. Thus, a known two component applicator assembly also presently available from Minnesota Mining and Manufacturing Company of St. Paul, Minn., could advantageously be converted into a different component number multi-component applicator assembly. Moreover, an auxiliary plunger need not be added since the drive rod thereof can be advantageously used as the auxiliary plunger.

As apparent from the description of the plural embodiments above, an advantageous convertible multi-component applicator assembly can be provided. Although such multi-component applicators are typically used for dispensing adhesives, such as epoxy adhesives, the present invention finds applicability to the dispensing of any plural component mixtures which are to be mixed prior to use and which may need to be stored separately. Thus, novel three part chemistries for adhesives or other can be accommodated. Moreover, additives, such as colors, flame retardant, fillers, conductive particles, etc., can be added during the dispensing process so as to avoid settling of such additives during storage of the component materials before use.

We claim:

1. An applicator assembly for concurrently dispensing a plurality of flowable component materials, comprising:

a plurality of barrels fixed with one another, at least two of the barrels for containing a flowable component material and having a discharge port through which the flowable component material is to be concurrently dispensed from said applicator assembly;

a removable barrel assembly releasably attached to said fixed plurality of barrels, said removable barrel assembly including at least one removable barrel for containing a flowable component material and having a discharge port through which the flowable component material is to be dispensed with the other component materials; and means for concurrently dispensing the flowable component materials from said discharge ports of said at least two barrels of said fixed plurality of barrels and said discharge port of said at least one removable barrel of said removable barrel assembly.

2. The applicator assembly of claim 1, wherein said means for concurrently dispensing the flowable component materials comprises a plunger assembly comprising a plunger for each of said at least two barrels of said fixed plurality of barrels and for said at least one removable barrel and an advancing means for driving an end of each plunger of said plunger assembly that is insertable within the fixed and removable barrels, respectively, at the same time and over the same displacement.

3. The applicator assembly of claim 2, wherein said plungers are operatively connected with one another.

4. The applicator assembly of claim 3, wherein the plungers for each of said at least two barrels of said fixed plurality of barrels are fixed together, and the plunger for the at least one removable barrel is removably attached to the fixed plungers.

5. The applicator assembly of claim 4, wherein the removable plunger is provided with a hub having an axis extending perpendicular to the longitudinal axis of the removable plunger, and a portion of said hub is inserted within a hole defined through a connecting web portion of the fixed plurality of plungers for removably connecting the removable plunger to the fixed plungers.

6. The applicator assembly of claim 5, wherein said connecting web portion extends transversely between the fixed plurality of plungers substantially at distal ends of the fixed plungers away from the ends thereof which are inserted within said at least two barrels of said fixed plurality of barrels.

7. The applicator assembly of claim 4, further including a nozzle adapter that is releasably connected to the discharge ports of said at least two barrels of said fixed plurality of barrels and said at least one removable barrel, said nozzle adapter provided with internal passages for providing a flow path from each barrel to which said nozzle adapter is releasably attached, and said internal passages open into a common passage within which the plural component materials are mixed with one another and which leads to a single adapter outlet.

8. The applicator assembly of claim 3, wherein said advancing means includes an applicator housing, a drive rod passing through said applicator housing and operatively connected with the plungers for said at least two barrels of said fixed plurality of barrels, and a drive means for driving said drive rod longitudinally, said drive rod further being insertable within and acting as the plunger for said at least one removable barrel.

9. The applicator assembly of claim 8, further including a nozzle adapter that is releasably connected to the discharge ports of said at least two barrels of said fixed plurality of barrels and said at least one removable barrel, said nozzle adapter provided with internal passages for providing a flow path from each barrel to which said nozzle adapter is releasably attached, and said internal passages open into a common passage within which the plural component materials are mixed with one another and which leads to a single adapter outlet.

10. The applicator assembly of claim 2, wherein said advancing means includes an applicator housing and said fixed plurality of barrels are detachably connected to said applicator housing.

11. The applicator assembly of claim 1, further including a nozzle adapter that is releasably connected to the discharge ports of said fixed plurality of barrels and said at least one removable barrel, said nozzle adapter provided with an internal passage for each barrel to which said nozzle adapter is releasably attached, and each internal passage opens into a common passage within which the plural component materials are mixed with one another and which leads to a single adapter outlet.

12. The applicator assembly of claim 11, further including a static mixing element detachably connected to said adapter outlet, said static mixing element having a passageway defined therethrough with an inlet proximate to said adapter outlet and an dispensing outlet from which mixed component materials are dispensed, and a mixing means within said passageway for enhancing the mixing of the component materials.

13. The applicator assembly of claim 11, wherein said removable barrel assembly includes a positioning means which locates said removable barrel assembly longitudinally with respect to said fixed plurality of barrels, and said positioning means along with the releasable connection of said nozzle adapter to said discharge port of said at least one removable barrel comprises the releasable attachment of said removable barrel assembly to said fixed plurality of barrels.

14. The applicator assembly of claim 13, wherein said positioning means comprises perpendicularly depending spaced flange portions from said removable barrel assembly between which a perpendicularly extending element of said fixed plurality of barrels is engaged.

15. The applicator assembly of claim 1, wherein said removable barrel assembly includes a plurality of removable barrels which are fixedly connected with one another.

16. The applicator assembly of claim 1, wherein said removable barrel assembly includes a plurality of removable barrels which are detachably connected with one another.

17. A multicomponent applicator kit which is convertible between plural different component number multicomponent applicator assembly arrangements for concurrently dispensing a plurality of flowable component materials in each arrangement, comprising:

a barrel assembly including three barrels, each for containing a flowable component material and having a discharge port through which the flowable component material is to be concurrently dispensed, wherein one barrel is detachably connected with the other barrels of said barrel assembly;

means for concurrently dispensing the plurality of flowable component materials from said discharge ports of said barrels of said barrel assembly for each arrangement; and nozzle means for receiving the component materials from said discharge ports of said barrels, for mixing said component materials and dispensing said component materials from a single discharge outlet, said nozzle means comprising a first nozzle element and a nozzle adapter;

wherein, in a first arrangement with said detachable barrel connected with said barrel assembly, said nozzle adapter is releasably positioned between said discharge ports and said first nozzle element, and in a second arrangement without said detachable barrel connected with said barrel assembly, said first nozzle element is positioned to receive the component materials from said discharge ports without said nozzle adapter therebetween.

18. The multicomponent applicator kit of claim 17, wherein said means for concurrently dispensing the flowable component materials comprises a plunger assembly comprising a plunger for each of said barrels of said barrel assembly and an advancing means for driving an end of each plunger of said plunger assembly that is insertable within said barrels at the same time and over the same displacement.

19. The multicomponent applicator kit of claim 18, wherein said plungers are operatively connected with one another.

20. The multicomponent applicator kit of claim 19, wherein the plunger for said detachable barrel is removably attached to the plunger assembly, and further wherein said removable plunger is detached from said plunger assembly when said multicomponent applicator assumes said second arrangement.

21. The multicomponent applicator kit of claim 20, wherein the removable plunger is provided with a hub having an axis extending perpendicular to the longitudinal axis thereof, and a portion of said hub is inserted within a hole defined through a connecting web portion of said plunger assembly for removably connecting the removable plunger to said plunger assembly.

22. The multicomponent applicator kit of claim 21, wherein said connecting web portion extends transversely between plungers of the plunger assembly substantially at distal ends of the plungers away from the ends thereof which are inserted within said barrels.

23. The multicomponent applicator kit of claim 19, wherein said advancing means includes an applicator housing, a drive rod passing through said applicator housing and operatively connected with the plunger assembly, and a drive means for driving said drive rod longitudinally, said drive rod further being insertable within and acting as the plunger for said detachable barrel.

24. The multicomponent applicator kit of claim 18, wherein said advancing means includes an applicator housing and said plurality of barrels are detachably connected to said applicator housing.

25. The multicomponent applicator kit of claim 17, wherein said first nozzle element comprises a static mixing element having a passageway defined therethrough with an inlet for receiving component materials from said barrels and a dispensing outlet from which mixed component materials are dispensed, and a mixing means within said passageway for enhancing the mixing of the component materials.

26. The multicomponent applicator kit of claim 17, wherein said detachable barrel includes a positioning means which locates said detachable barrel longitudinally with respect to said barrel assembly, and said positioning means along with the releasable connection of said nozzle adapter to said discharge port of said removable barrel, when in said first arrangement, comprises the detachable connection of said detachable barrel to said barrel assembly.

27. The multicomponent applicator kit of claim 26, wherein said positioning means comprises perpendicularly depending spaced flange portions from said detachable barrel between which a perpendicularly extending element of said barrel assembly is engaged.

28. The multicomponent applicator kit of claim 17, wherein there are more than three barrels within said barrel assembly, and there are at least two removable barrels which are fixedly connected with one another.

29. The multicomponent applicator kit of claim 17, wherein there are more than three barrels within said barrel assembly, and there are at least two removable barrels which are detachably connected with one another.

30. In combination with the multicomponent applicator kit of claim 17, said barrels being at least partially filled with component materials of an epoxy adhesive.

31. The combination of claim 30, wherein one barrel is provided with an epoxy resin, one other barrel is provided with a curing agent, and said detachable barrel is provided with an additive selected from the group of: a colorant, a flame retardant, a conductive filler, and a catalyst.

32. A supplemental component assembly for converting a multicomponent applicator device, which is used for concurrently dispensing a plurality of flowable component materials, into an increased component number multicomponent applicator assembly, said supplemental component assembly comprising a detachable barrel assembly including at least one removable barrel having a discharge port at one end thereof, said detachable barrel assembly including means for detachably connecting said at least one removable barrel to a barrel assembly of the multicomponent applicator device, and a nozzle adapter means which releasably connects with said discharge port of said at least one removable barrel and is further connectible with discharge ports of each component barrel of the multicomponent applicator device, said nozzle adapter means having passages for providing flow paths from each of the discharge ports to a common passage within said nozzle adapter means within which the component materials are mixed with one another and which leads to a single adapter outlet.

33. The supplemental component assembly of claim 32, further including a means for dispensing a component material from within said at least one removable barrel that is operatively connectible with a means for concurrently dispensing a plurality of component materials from the multicomponent applicator device so that the component material provided within said at least one removable barrel is concurrently dispensed with the component materials of the multicomponent applicator device.

34. The supplemental component assembly of claim 33, wherein said means for dispensing a component material from within said at least one removable barrel comprises a plunger assembly including a plunger having an end thereof for insertion within said at least one removable barrel, said plunger assembly provided with a means for detachably connecting said plunger assembly to a plunger assembly of the multicomponent applicator device so as to move therewith.

35. The supplemental component assembly of claim 34, wherein said detachable plunger is provided with a hub having an axis extending perpendicular to the longitudinal axis thereof, and a portion of said hub is insertable within a hole defined through a connecting web portion of the plunger assembly of the multicomponent applicator device.

36. The supplemental component assembly of claim 32, wherein said at least one removable barrel includes a positioning means for locating said at least one removable barrel longitudinally with respect to the barrel assembly of the multicomponent applicator device, and said positioning means along with the releasable connection of said nozzle adapter means to said discharge port of said at least one removable barrel, when said nozzle adapter means is connected with the discharge ports of the barrels of the multicomponent applicator device, comprises said means for detachably connecting said at least one removable barrel to the barrel assembly of the multicomponent applicator device.

37. The supplemental component assembly of claim 36, wherein said positioning means comprises perpendicularly depending spaced flange portions from said at least one removable barrel between which a perpendicularly extending element of the barrel assembly of the multicomponent applicator device is engageable.

38. The supplemental component assembly of claim 32, wherein said detachable barrel assembly comprises a plurality of removable barrels which are fixedly connected with one another.

39. The supplemental component assembly of claim 32, wherein said detachable barrel assembly comprises a plurality of removable barrels which are detachably connected with one another.

* * * * *